US010745222B2

(12) United States Patent
Fuse

(10) Patent No.: US 10,745,222 B2
(45) Date of Patent: Aug. 18, 2020

(54) STACKING DEVICE AND IMAGE FORMING APPARATUS

(71) Applicant: CANON KABUSHIKI KAISHA, Tokyo (JP)

(72) Inventor: Yasuhiko Fuse, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/122,112

(22) Filed: Sep. 5, 2018

(65) Prior Publication Data

US 2019/0002219 A1 Jan. 3, 2019

Related U.S. Application Data

(63) Continuation of application No. 14/790,493, filed on Jul. 2, 2015, now abandoned.

(30) Foreign Application Priority Data

Jul. 8, 2014 (JP) ..... 2014-140588

(51) Int. Cl.

| | |
|---|---|
| ***B65H 1/00*** | (2006.01) |
| ***B65H 1/14*** | (2006.01) |
| ***B65H 1/26*** | (2006.01) |
| ***B65H 7/02*** | (2006.01) |

(52) U.S. Cl.

CPC ..... *B65H 1/14* (2013.01); *B65H 1/266* (2013.01); *B65H 7/02* (2013.01); *B65H 2511/10* (2013.01); *B65H 2511/20* (2013.01); *B65H 2553/25* (2013.01); *B65H 2553/61* (2013.01)

(58) Field of Classification Search

CPC ..... B65H 1/00; B65H 2405/00; B65H 2405/1116; B65H 2405/112; B65H 2405/113; B65H 2405/114; B65H 2511/10; B65H 2511/12; B65H 2701/1131

See application file for complete search history.

(56) References Cited

U.S. PATENT DOCUMENTS

2007/0182088 A1* 8/2007 Tomura ..... G03G 15/6502 271/157

* cited by examiner

*Primary Examiner* — Thomas A Morrison
(74) *Attorney, Agent, or Firm* — Canon U.S.A., Inc. I.P. Division

(57) ABSTRACT

A stacking device includes a stacking unit, a regulation member, an interlocking member, a pivoting member provided on the interlocking member, a sensor having an output, and a determination unit. The stacking unit stacks a sheet on the stacking unit. The regulation member moves in a first direction and a second direction opposite to the first direction and regulates a position of the sheet by abutting on an edge of the sheet stacked in the stacking unit. The interlocking member interlocks with the regulation member. The pivoting member rotates. The sensor output changes based on positions of the interlocking member and the pivoting member. The determination unit determines a size of the sheet based on the output of the sensor.

10 Claims, 15 Drawing Sheets

STACKING DEVICE AND IMAGE FORMING APPARATUS

CROSS-REFERENCE TO RELATED APPLICATIONS

This application is a continuation of U.S. patent application Ser. No. 14/790,493, filed Jul. 2, 2015, which claims the benefit of Japanese Patent Application No. 2014-140588, filed Jul. 8, 2014, all of which are hereby incorporated by reference herein in their entirety.

BACKGROUND OF THE INVENTION

Field of the Invention

The present invention relates to a stacking device and an image forming apparatus.

Description of the Related Art

Conventionally, some image forming apparatuses such as copying machines and printers includes a size detection unit that detects the size of sheets accommodated in a feeding cassette.

In one system for detecting the size, the size of stacked sheets is detected based on a position of a regulation plate that regulates a position of the sheets. More specifically, there is a system for detecting the size of the sheets by detecting a position of a detection plate using a detection unit provided in a main body of an image forming apparatus. The detection plate interlocks with the regulation plate and includes openings, which are provided according to a certain rule.

At this time, to detect the size of the sheets, the length of the detection plate needs to be the same as an amount of movement of the regulation plate. Further, to accommodate the detection plate in a feeding cassette, a space which is approximately twice the length of the detection plate is required for the feeding cassette that accommodates the sheets. Consequently, the size of the feeding cassette increases.

Japanese patent Application Laid-Open No. 2000-219326 discusses a feeding cassette including two detection plates, which are substantially the same in length, each having openings. More specifically, the first detection plate interlocks with a trailing edge regulation plate in a region from a position furthest from a feeding roller to the center of a movement range, and the second detection plate interlocks with the trailing edge regulation plate in a region from the center of the movement range to a position closest to the feeding roller. A sensor provided in a main body of an image forming apparatus detects the openings provided in each of the two detection plates.

The configuration discussed in Japanese Patent Application Laid-Open No. 2000-219326 is effective if a maximum sheet-passing size in the main body of the image forming apparatus is assumed to be the A3 size (297 mm in width×420 mm in length). However, in an image forming apparatus targeting smaller sizes (e.g., whose maximum sheet-passing size is the Legal (LGL) size (216 mm in width×356 mm in length) or the A4 size (297 mm in width×210 mm in length)), the configuration discussed in Japanese Patent Application Laid-Open No. 2000-219326 which requires the two detection plates having substantially the same length, may lead to a complicated structure and cost rise, and is not necessarily the most suitable.

Further, in the configuration discussed in Japanese Patent Application Laid-Open No. 2000-219326, it is necessary to distinguish between a state where the sensor is turned on by both of the first and second detection plates and a state where the sensor is turned on by either one of the first and second detection plates. The first and second detection plates have substantially the same thicknesses. More specifically, in the configuration discussed in Japanese Patent Application Laid-Open No. 2000-219326, the sensor needs to have high detection accuracy.

SUMMARY OF THE INVENTION

The present invention is directed to a stacking device capable of determining the size of a sheet by a simple configuration and an image forming apparatus including the stacking device. In an example, a stacking device including a switch whose output changes depending on positions of a first detection plate having openings and a second detection plate provided so as to pivot around a pivot point on the first detection plate, and an image forming apparatus including the stacking device.

According to an aspect of the present invention, a stacking device includes a stacking unit configured to stack a sheet on the stacking unit, a regulation member configured to be movable in a first direction and a second direction opposite to the first direction and configured to regulate a position of the sheet by abutting on an edge of the sheet stacked in the stacking unit, an interlocking member configured to interlock with the regulation member, a pivoting member provided on the interlocking member and configured to rotate, a sensor having an output configured to change based on positions of the interlocking member and the pivoting member, and a determination unit configured to determine a size of the sheet based on the output of the sensor.

Further features of the present invention will become apparent from the following description of exemplary embodiments with reference to the attached drawings.

DESCRIPTION OF THE EMBODIMENTS

Figure 1A:
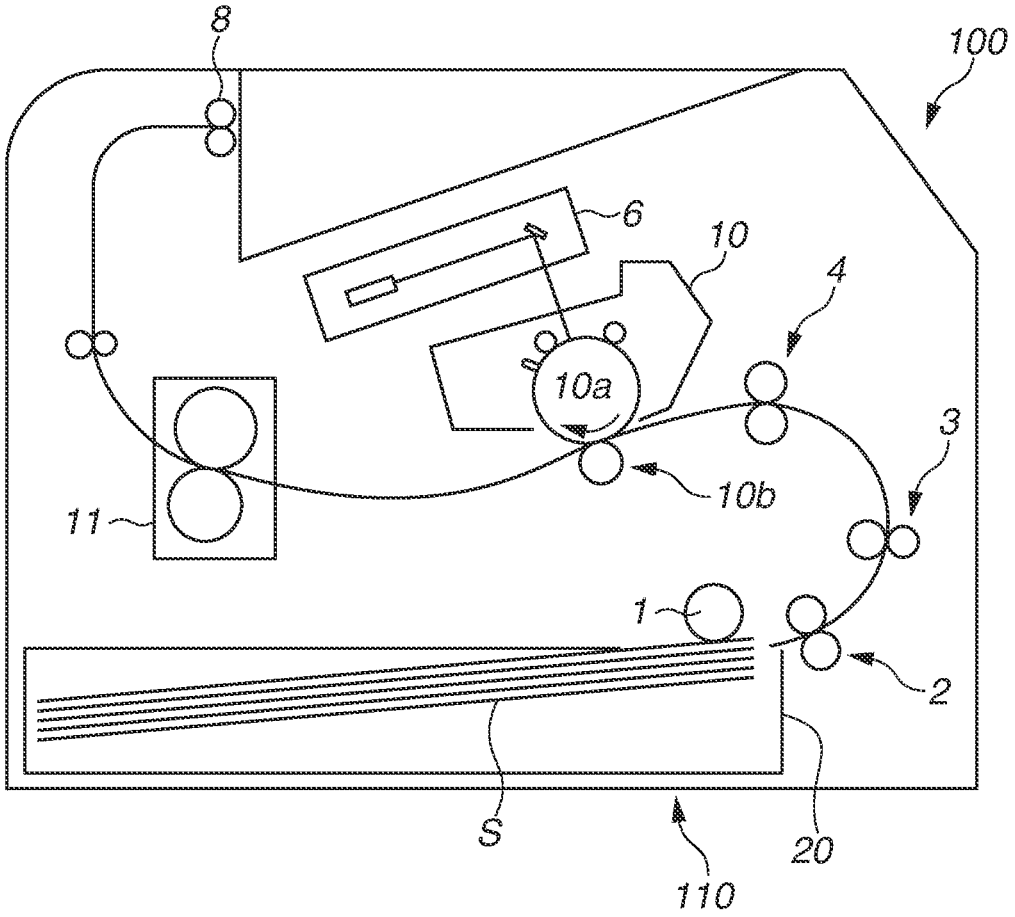
FIGS. 1A and 1B are respectively a schematic sectional view and a schematic perspective view of an image forming apparatus according to a first exemplary embodiment.

A first exemplary embodiment of the present invention will be described in detail below with reference to the drawings. FIG. 1A is a schematic sectional view illustrating a configuration of an image forming apparatus (laser beam printer) 100 including a stacking device 110 according to the first exemplary embodiment.

As illustrated in FIG. 1A, the image forming apparatus 100 includes a feeding cassette (a stacking unit) 20 that accommodates sheets S on which an image is to be formed, and a pick roller (a feeding member) 1 that feeds the sheets S in the feeding cassette 20 one by one. The image forming apparatus 100 includes conveyance roller pairs 2 and 3, which convey the sheet S fed by the pick roller 1, and a registration roller pair 4. The conveyance roller pair 2 includes a feed roller and a separation roller opposing the feed roller. The image forming apparatus 100 includes a process cartridge 10 and a laser scanner 6 that irradiates an electrophotographic photosensitive member 10*a* with light based on image information. Moreover, the image forming apparatus 100 includes a transfer roller 10*b* that transfers an image formed on the electrophotographic photosensitive member 10*a* onto the sheet S, a fixing unit 11 that fixes the transferred image to the sheet S, and a discharge roller pair 8 that discharges the sheet S.

The process cartridge 10 is detachably attached to the image forming apparatus 100, and is unitized. The process cartridge 10 includes a charging unit that charges the electrophotographic photosensitive member 10*a*, a development unit that develops an electrostatic latent image formed on the electrophotographic photosensitive member 10*a*, and a cleaning unit that cleans a toner material remaining on the surface of the electrophotographic photosensitive member 10*a*.

An operation of the image forming apparatus 100 when an image is formed on the sheets S will be described. The image forming apparatus 100 irradiates the electrophotographic photosensitive member 10*a*, which is primarily charged from the laser scanner 6, with light based on image information, and forms an electrostatic latent image on the surface of the electrophotographic photosensitive member 10*a*. The electrostatic latent image is developed, to form a visible image. In the image forming apparatus 100, the pick roller 1 feeds the sheets S accommodated in the feeding cassette 20. The conveyance roller pairs 2 and 3 convey the sheet S fed by the pick roller 1 to the registration roller pair 4. In the image forming apparatus 100, the registration roller pair 3 conveys the sheet S to a transfer unit in synchronization with the formation of the visible image. The sheet S on which a toner image has been transferred by the transfer unit is conveyed to the fixing unit 11. The fixing unit 11 fixes the toner image to the sheet S. The discharge roller pair 8 discharges the sheet S to which the toner image has been fixed out of the image forming apparatus 100.

Figure 1B:
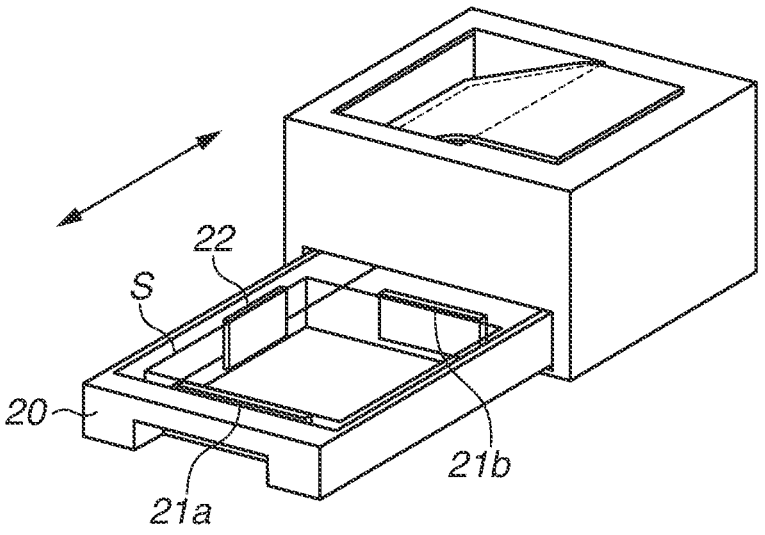

FIG. 1B is a schematic perspective view of the image forming apparatus 100 as viewed obliquely from above its side surface. The feeding cassette 20 includes width regulation plates 21*a* and 21*b* that regulate a position of a side edge in a direction orthogonal to a feeding direction of the stacked sheets S, and a trailing edge regulation plate (trailing edge regulation member) 22 that regulates a position of a trailing edge (an edge) in the feeding direction of the sheets S. The feeding cassette 20 is provided so as to be drawn in a direction indicated by an arrow orthogonal to the feeding direction in the front surface of the image forming apparatus 100.

According to the first exemplary embodiment, the size of the sheets S which can be accommodated in the feeding cassette 20 is from the A6 size (105 mm in width×148 mm in length) to the Legal (LGL) size (216 mm in width×356 mm in length). According to the first exemplary embodiment, the size of the sheets S, which is the A5 size or larger, can be identified. The feeding cassette 20 can accommodate sheets S of other standard sizes such as the A5 size (148 mm in width×210 mm in length), the B5 size (182 mm in width×257 mm in length), the Executive (EXE) size (184 mm in width×267 mm in length), the Letter (LTR) size in portrait orientation (216 mm in width×279 mm in length), and the A4 size in portrait orientation (210 mm in width×297 mm in length).

Figure 2:
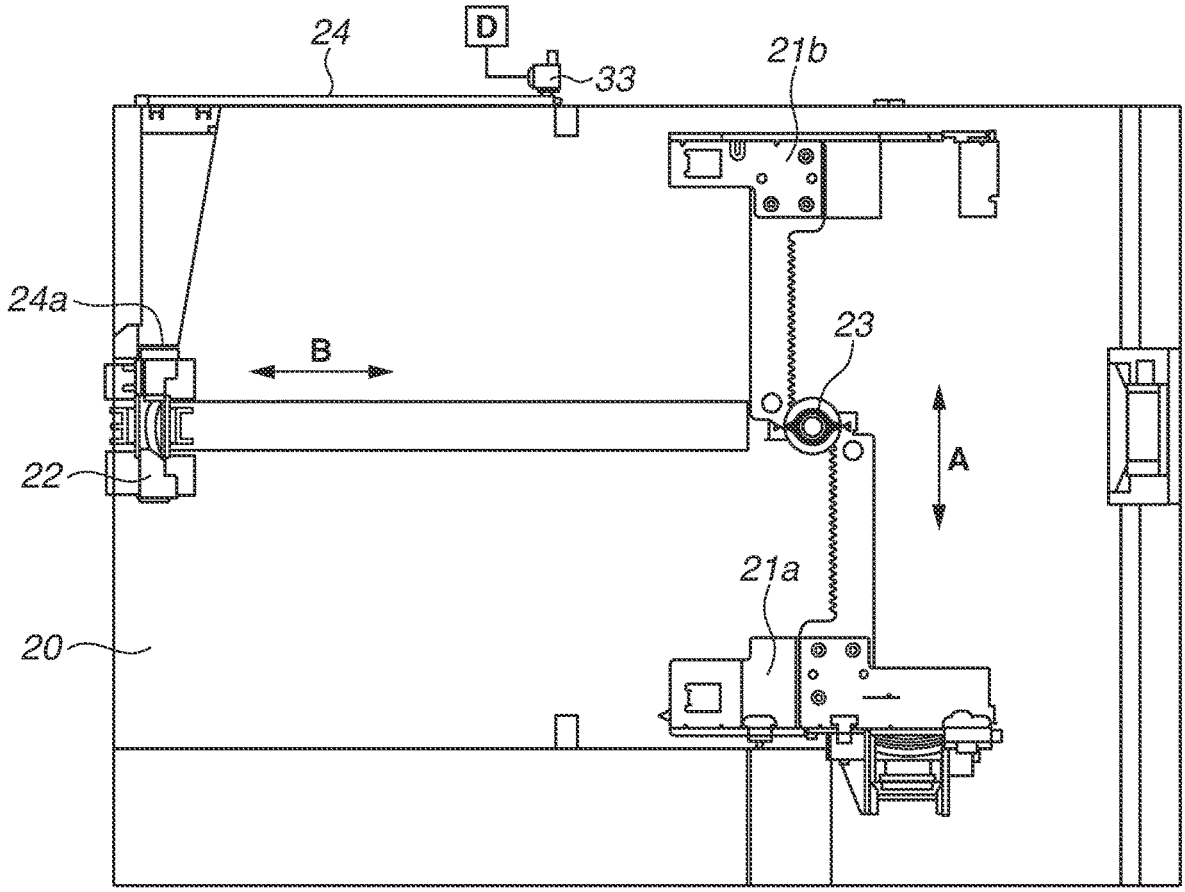
FIG. 2 is a top view of a feeding cassette according to the first exemplary embodiment.

FIG. 2 is a cross-sectional view of the feeding cassette 20 according to the first exemplary embodiment as viewed from above. The width regulation plate 21*a* and the width regulation plate 21*b* are connected to each other with a pinion gear 23, and are configured to interlock with each other in a direction indicated by an arrow A. A user can move the width regulation plate 21*a* and the width regulation plate 21*b* to the corresponding positions matching the size in a width direction of the stacked sheets S. The trailing edge regulation plate 22 is movably provided in a direction indicated by an arrow B (the feeding direction (a first direction) and a direction opposite thereto (a second direction)) along a slit. The user can move the trailing edge regulation plate 22 to a position matching the size in the feeding direction of the stacked sheets S.

Figure 3:
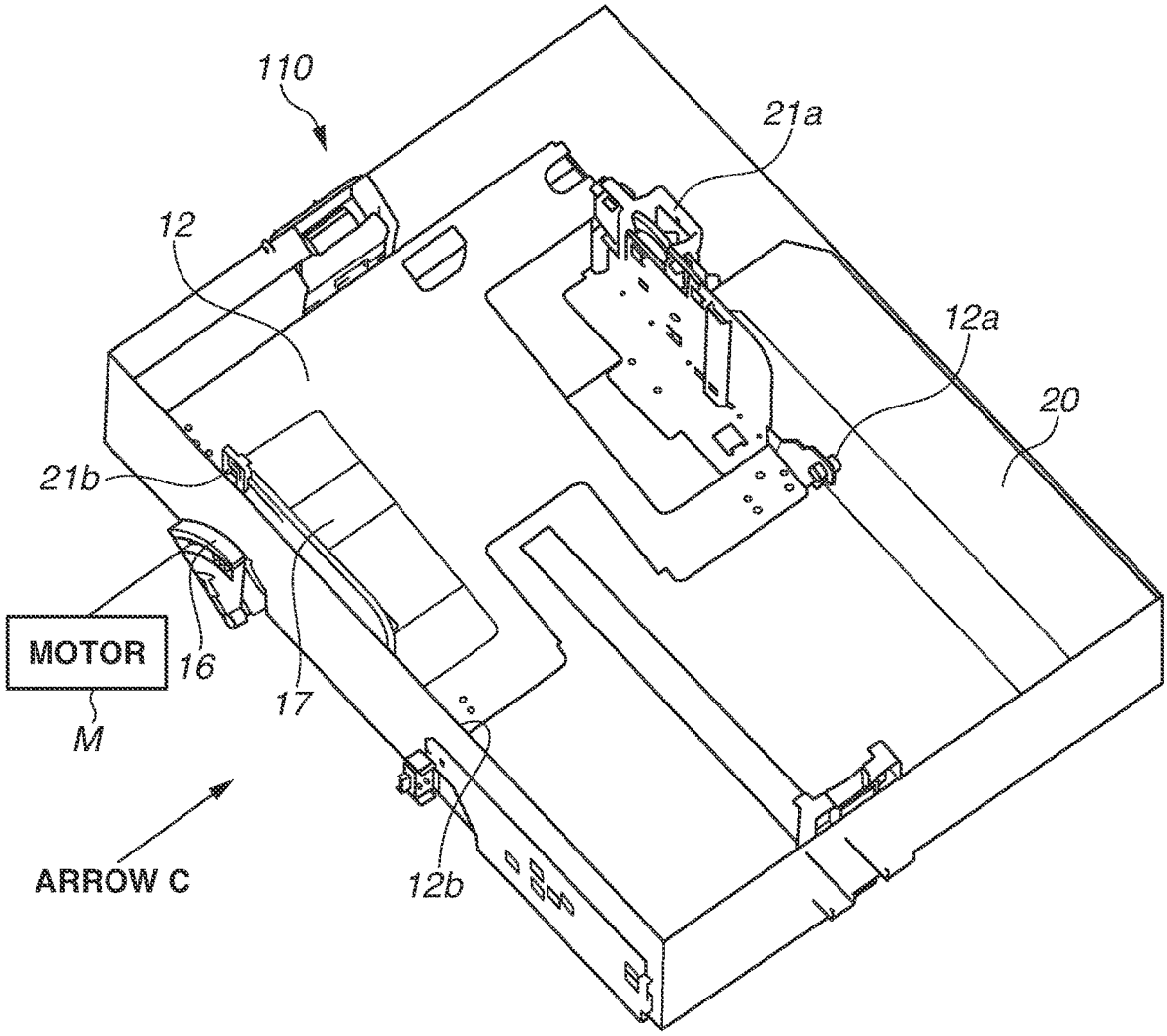
FIG. 3 is a perspective view of the feeding cassette according to the first exemplary embodiment.

FIG. 3 is a perspective view of the feeding cassette 20 according to the first exemplary embodiment as viewed obliquely from above. A stacking plate (stacking member) 12 on which sheets S are stacked is provided so as to pivot around pivot points 12*a* and 12*b*. The stacking plate 12 pivots upwards by a lifter gear 16 driven by a motor M (a driving source) provided in a main body of the image forming apparatus 100 and a lift-up plate 17 connected to the lifter gear 16. The stacking plate 12 pivots upwards according to the number of the stacked sheets S so that predetermined pressure (feeding pressure) of the sheets S stacked on the stacking plate 12 against the pick roller 1 is maintained.

Figure 4:
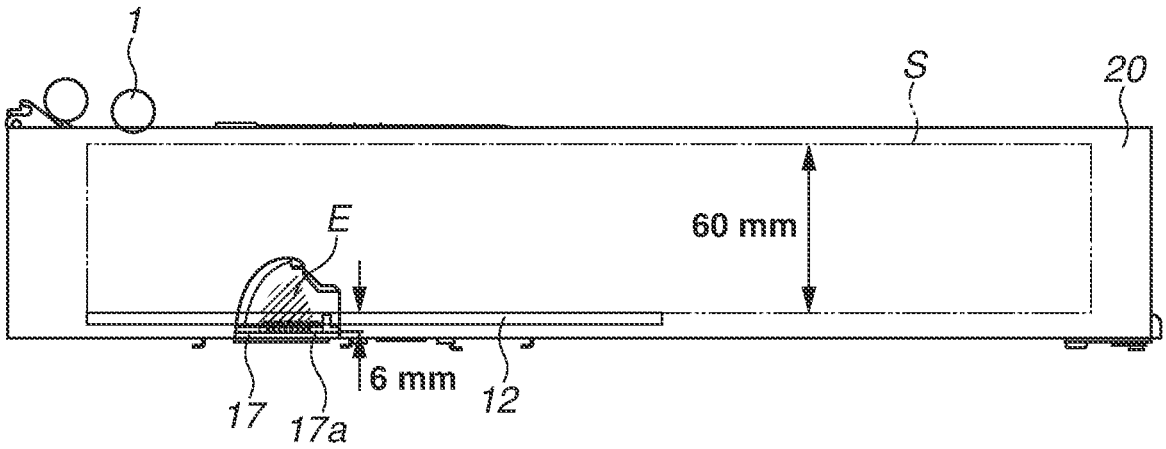
FIG. 4 is a side view of the feeding cassette according to the first exemplary embodiment.

FIG. 4 is a side view of the feeding cassette 20 as viewed from an arrow C illustrated in FIG. 3. The sheets on the stacking plate 12 can be stacked up to a height of 60 mm. The image forming apparatus 100 sequentially lifts up the stacking plate 12 as the number of the stacked sheets S decreases from a fully stacked state of 60 mm to the final one sheet, to make the sheet S abut on the pick roller 1. At this time, the lift-up plate 17 pivots around the pivot point 17*a* within a range of a hatched area E illustrated in FIG. 4. According to the first exemplary embodiment, the lift-up plate 17 includes a flat plate or a shaft made of a metal, as needed, and is arranged below the stacking plate 12. The pivot point 17*a* of the lift-up plate 17 is positioned approximately 6 mm below a lowermost edge of the sheet S before the stacking plate 12 is lifted up. The pivot radius of the hatched area E is approximately 21 mm.

The feeding cassette 20 includes a first detection plate (an interlocking member) 24 that integrally moves with (interlocks with) the trailing edge regulation plate 22 in the direction indicated by the arrow B. A second detection plate (a turning member) 25, described below, is rotatably provided on the first detection plate 24.

Figure 5:
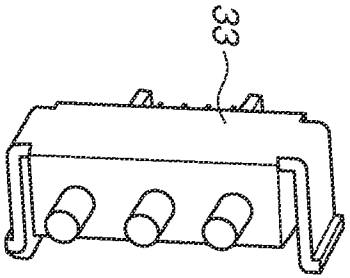
FIG. 5 is a perspective view of a switch according to the first exemplary embodiment.

A switch (sensor) 33, which is turned on/off, and a determination unit D, which determines the size of the sheets S according to an output of the switch 33, are provided in the main body of the image forming apparatus 100. As illustrated in FIG. 5, the switch 33 includes three pin switches that can be separately turned on/off. Each of the three pin switches generally remains projected by 5 mm with the use of an elastic member provided inside the switch 33, and is recognized to be in an off state in this position. When a pin switch is pushed in by 3.5 mm to 5 mm by a detection surface 24*a* of the first detection plate 24 or a detection surface 25*a* of the second detection plate 25, the pin switch is recognized to be in an on state. The determination unit D determines the size of the sheet S based on each state of the three pin switches.

According to the first exemplary embodiment, a size detection unit, which detects the size of the sheets S, includes the first detection plate 24, the second detection plate 25, the switch 33, and the determination unit D.

A configuration of the first detection plate 24 and the second detection plate 25 according to the first exemplary embodiment will be specifically described below.

Figure 6A:
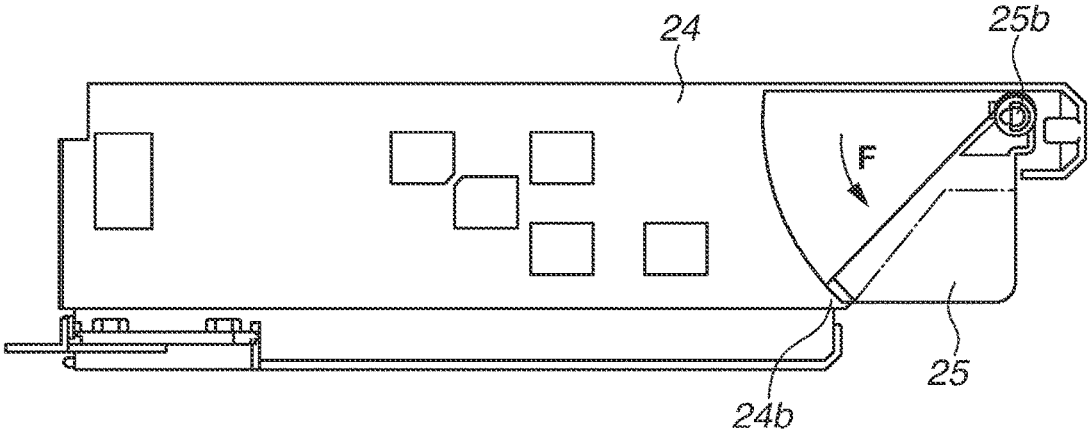
FIGS. 6A and 6B are respectively a side view of a first detection plate and a second detection plate according to the first exemplary embodiment and a side view of the first detection plate and the second detection plate according to the first exemplary embodiment.
Figure 6B:
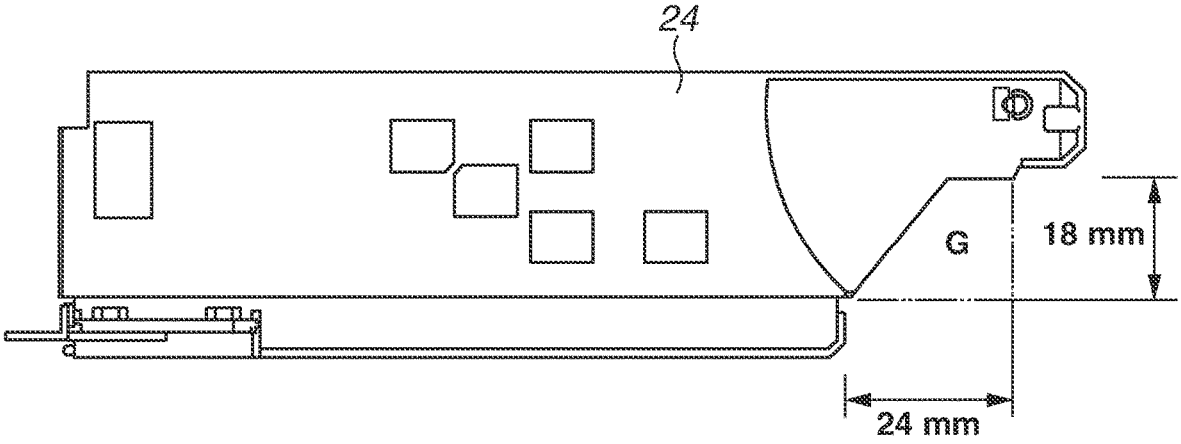

FIGS. 6A and 6B are cross-sectional views illustrating the first detection plate 24 and the second detection plate 25 in an enlarged scale. To simplify description, the second detection plate 25 is not illustrated in FIG. 6B. The first detection plate 24 has a plurality of openings provided according to a certain rule. A cutout portion G is formed in the first detection plate 24. The specific size of the cutout portion G according to the first exemplary embodiment is as illustrated in FIG. 6B. The size of the cutout portion G is set so that a pivoting trajectory of the above-described lift-up plate 17 does not interfere with a sliding trajectory of the first detection plate 24.

As illustrated in FIG. 6A, the second detection plate 25 is attached to the first detection plate 24. The second detection plate 25 is provided so as to smoothly pivot around a pivot point 25*b* on the first detection plate 24. The center of gravity and the pivot point 25*b* of the second detection plate 25 are set so that the second detection plate 25 pivots in a direction indicated by an arrow F around the pivot point 25*b* by its own weight. The second detection plate 25 is configured to stop pivoting (be locked) by contacting a rib (locking portion) 24*b* provided in the first detection plate 24. At this time, the second detection plate 25 is configured to cover the cutout portion G in the first detection plate 24. The pivot point 25*b* of the second detection plate 25 is arranged above the cutout portion G in the vertical direction.

Figure 7:
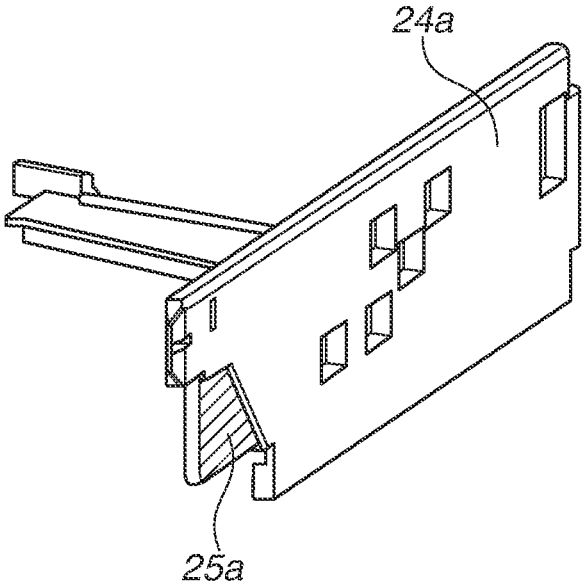
FIG. 7 is a perspective view of the first detection plate and the second detection plate according to the first exemplary embodiment.

FIG. 7 is a perspective view of the first detection plate 24 and the second detection plate 25. As illustrated in FIG. 7, the first detection plate 24 is made partially thin (in a trajectory of the second detection plate 25) so that a gap in the thickness direction between the detection surface 24*a* of the first detection plate 24 and the detection surface 25*a* of the second detection plate 25 is as small as possible. According to the first exemplary embodiment, the gap is 0.8 mm. In other words, the first detection plate 24 has a thin portion having a smaller thickness than that of the other portion, and the second detection plate 25 is rotatably attached to the thin portion.

Figure 8:
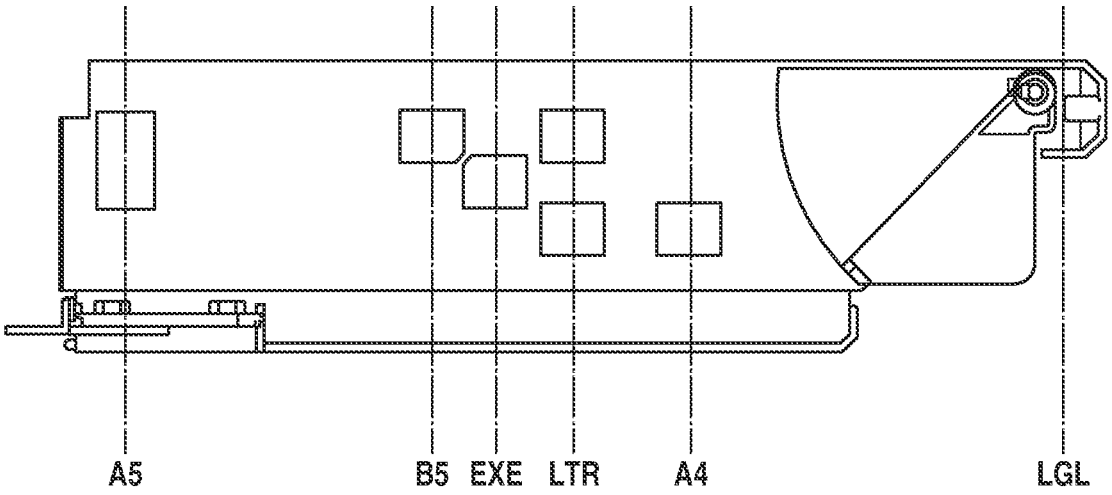
FIG. 8 is a side view illustrating a layout of openings of the first detection plate according to the first exemplary embodiment.

FIG. 8 illustrates a layout of the openings of the first detection plate 24. Each of the openings is formed to match the corresponding position of the trailing edge regulation plate 22 of each standard size. The switch 33 having the three pin switches is turned off when the openings of the first detection plate 24 are located at positions facing the pin switches (positions where the pin switches pass through the openings). When the first detection plate 24 or the second detection plate 25 pushes in the pin switches, the switch 33 outputs an ON signal.

In case of sheets S which are not of the standard sizes, all the three pin switches of the switch 33 are pushed in by the first detection plate 24 or the second detection plate 25 and turned on. If all the three pin switches of the switch 33 are off, it is recognized that the feeding cassette 20 has not been inserted into the image forming apparatus 100 (the feeding cassette 20 is drawn from the apparatus body).

More specifically, the switch 33 changes a signal to be output depending on the positions of the first detection plate 24 and the second detection plate 25. The determination unit D determines the size of the sheets S in response to the output from the switch 33.

States of the first detection plate 24 and 25 and the switch 33 when the trailing edge regulation plate 22 is set at positions corresponding to the sizes of some sheets S will be specifically described. The user moves the trailing edge regulation plate 22 while the feeding cassette 20 is drawn from the image forming apparatus 100.

Figure 9:
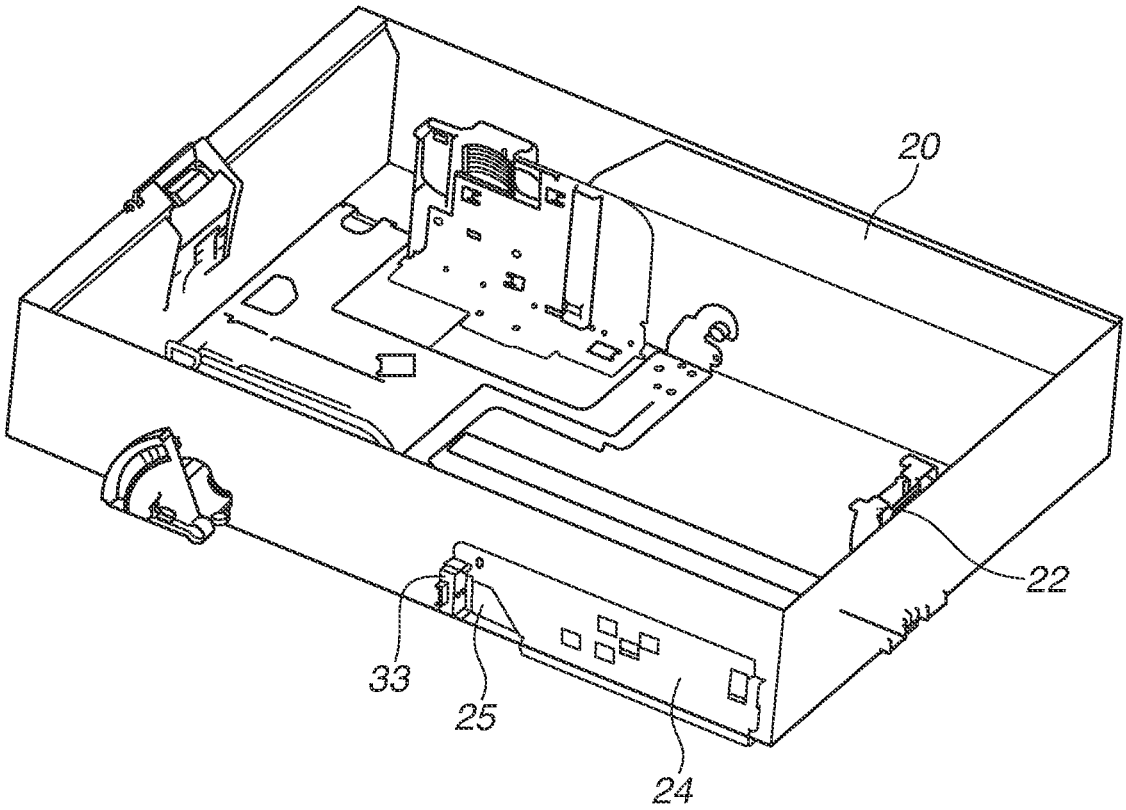
FIG. 9 is a perspective view of the feeding cassette when sheets of the LGL size are set therein according to the first exemplary embodiment.

FIG. 9 is a perspective view of the feeding cassette 20 when sheets S of the LGL size (216 mm in width×356 mm in length) are set. The trailing edge regulation plate 22 set at the position corresponding to the sheets S of the LGL size is positioned at a right end (on the upstream side in the feeding direction) of the feeding cassette 20. A relative positional relationship between the first and second detection plates 24 and 25 and the switch 33 is as illustrated in FIG. 9. At this time, the detection surface 24*a* of the first detection plate 24 pushes in only the uppermost one of the three pin switches of the switch 33. Consequently, each state of the three pin switches are on, off, and off from the top. The determination unit D identifies the states of the pin switches, and thus it is recognized that the size of the sheets S is the LGL size.

Figure 10A:
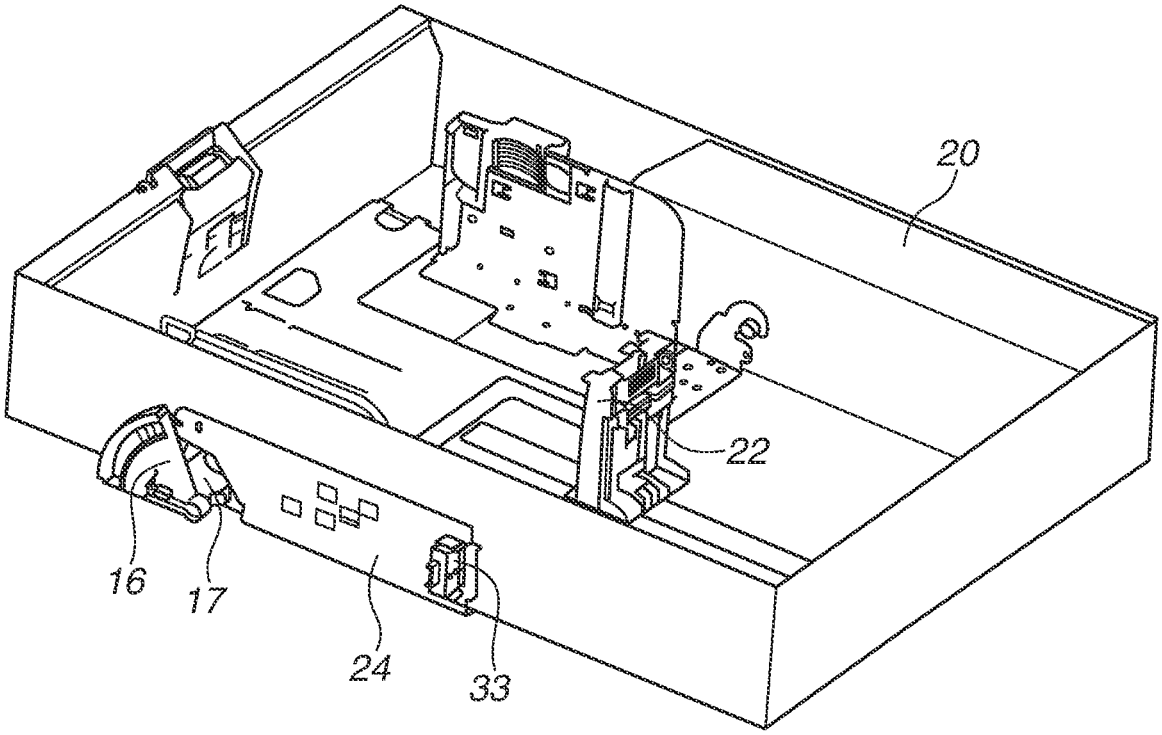
FIGS. 10A and 10B are respectively a perspective view and a side view of the feeding cassette when sheets of the A5 size are set therein according to the first exemplary embodiment.

FIG. 10A is a perspective view of the feeding cassette 20 when sheet S of the A5 size (148 mm in width×210 mm in length) is set. The trailing edge regulation plate 22 set at the position corresponding to the sheets S of the A5 size is positioned at a substantially central part of the feeding cassette 20. A relative positional relationship between the first and second detection plates 24 and 25 and the switch 33 is as illustrated in FIG. 10A. At this time, the first detection plate 24 pushes in only the lowermost one of the three pin switches of the switch 33. Consequently, each state of the three pin switches are off, off, and on from the top.

Figure 10B:
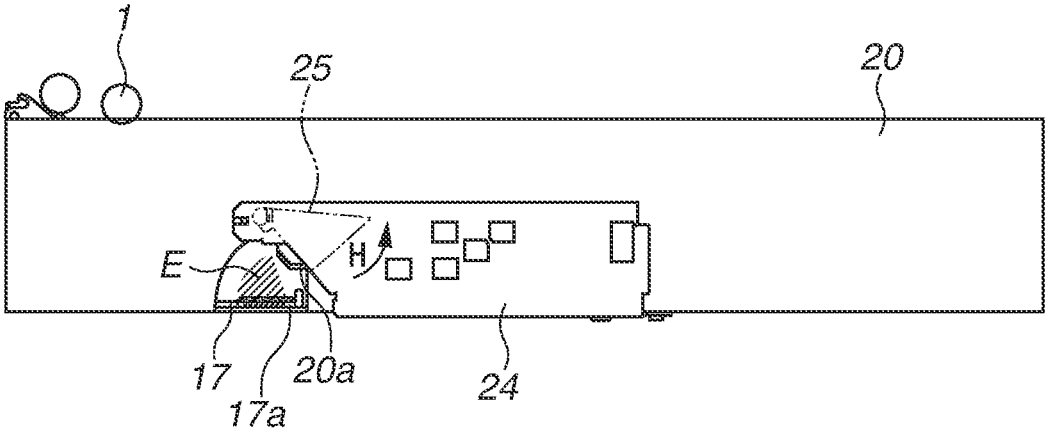

FIG. 10B is a side view of the feeding cassette 20 when sheets S of the A5 size are set. The second detection plate 25 rotatably provided on the first detection plate 24 pivots in a direction indicated by an arrow H (upward) against its own weight by contacting a protrusion (contact portion) 20*a* provided in the feeding cassette 20. At this time, a pivoting range of the second detection plate 25 is substantially accommodated within a maximum external form of the first detection plate 24. Therefore, according to the first exemplary embodiment, a peripheral space is not used to pivot the second detection plate 25. The cutout portion G of the first detection plate 24 is made sufficiently larger than the pivoting area E of the lift-up plate 17. Thus, the first detection plate 24 and the second detection plate 25 do not obstruct an operation of the lift-up plate 17. More specifically, a pivoting operation can be properly performed according to its original function depending on the number of sheets S stacked thereon.

As illustrated in FIG. 10B, according to the first exemplary embodiment, the second detection plate 25 can pivot depending on a position of the first detection plate 24. More specifically, when the trailing edge regulation plate 22 is moved toward the downstream side in the feeding direction from a predetermined position, the second detection plate 25 pivots upwards against its own weight by contacting (being pressed on) the protrusion 20*a* provided in the feeding cassette 20. The second detection plate 25 does not interfere with an operation of the lift-up plate 17 when pivoting upwards. According to the first exemplary embodiment, a part of the first detection plate 24 is thinned, and the second detection plate 25 pivots, which is smaller than the first detection plate 24. Thus, a space required for the feeding cassette 20 may be kept to the minimum necessary. Consequently, a free space can be effectively used for the feeding cassette 20.

Figure 11:
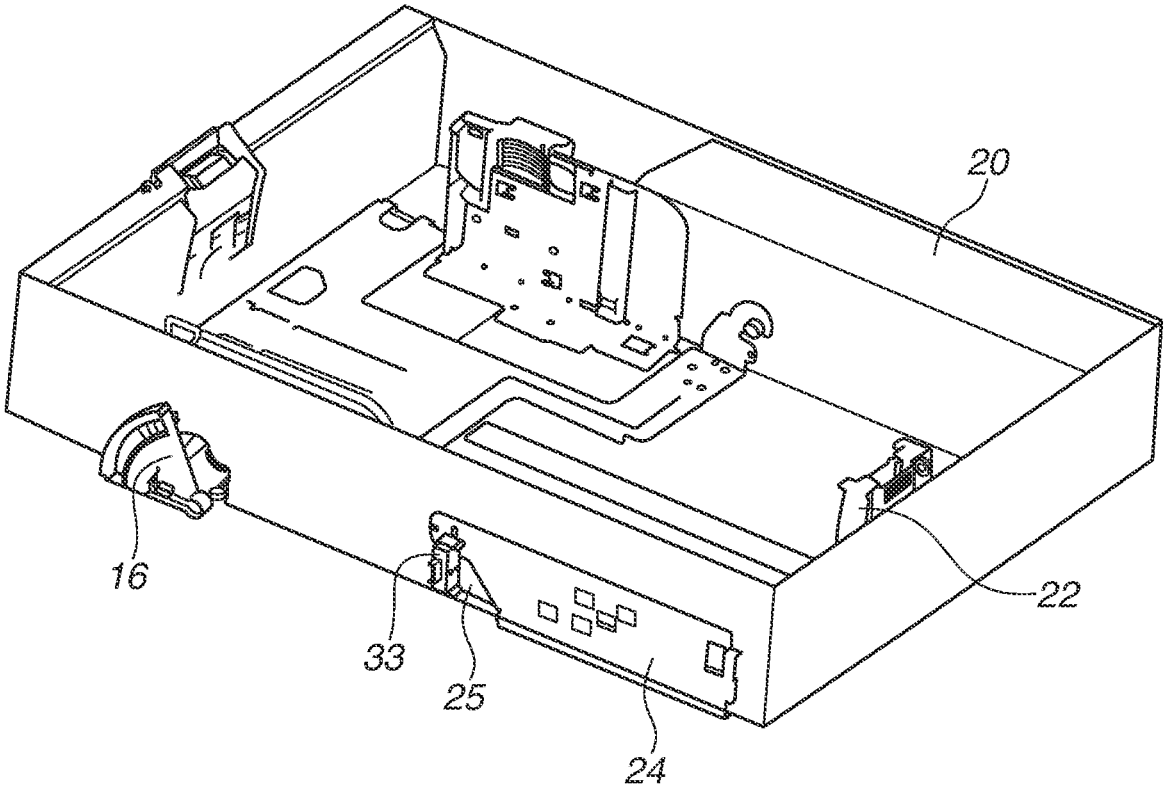
FIG. 11 is a perspective view of the feeding cassette when sheets of a non-standard size are set according to the first exemplary embodiment.
Figure 12:
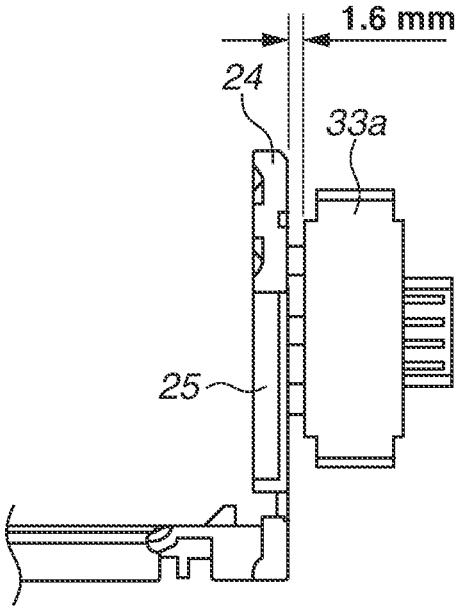
FIG. 12 is a cross-sectional view illustrating a positional relationship between the first and second detection plates and a switch according to the first exemplary embodiment.

FIG. 11 is a perspective view of the feeding cassette 20 when sheets S of a non-standard size (a size smaller by 10 mm than the LGL size in an example illustrated in FIG. 11) are set. The second detection plate 25 pivots downwards by its own weight, and stops at a position contacting the rib 24*b* provided in the first detection plate 24. FIG. 12 is an enlarged view of a peripheral portion when the first and second detection plates 24 and 25 contact the switch 33. As illustrated in FIG. 12, according to the first exemplary embodiment, a nominal distance between a housing 33*a* of the switch 33 and the detection surface 24*a* of the first detection plate 24 is 1.6 mm, and the gap between the detection surfaces of the first detection plate 24 and the second detection plate 25 is 0.8 mm, as described above. Accordingly, the accuracy is sufficient to recognize that the pin switches of the switch 33 are pushed in and turned on. More specifically, the first exemplary embodiment eliminates the need for a stroke conversion mechanism using a pin switch and a lever discussed in Japanese Patent Application Laid-Open No. 2000-219326, and can achieve high detection accuracy in a simple configuration.

According to the first exemplary embodiment, the second detection plate 25 pivots by its own weight. More specifically, the first exemplary embodiment eliminates the need to use an urging member for relatively moving the two detection plates, in the configuration as discussed in Japanese Patent Application Laid-Open No. 2000-219326.

The flow of the above-described operation will be simply described. The user stacks sheets S of a certain size on the feeding cassette 20, and then moves the trailing edge regulation plate 22 to a position where the sheets S are regulated. Thus, the first detection plate 24 and the second detection plate 25 also move to the positions corresponding to the stacked sheets S. In this state, when the feeding cassette 20 is mounted on the image forming apparatus 100, the size of the sheets S is recognized by the switch 33 and the determination unit D that determines the state of the switch 33. The switch 33 and the determination unit D are provided in the main body of the image forming apparatus 100.

While a configuration for detecting the length in the feeding direction of the sheets S has been described in the first exemplary embodiment, the present invention should not be limited to this embodiment. The present invention is also applicable to a configuration for detecting the length in the width direction of the sheets S (the direction orthogonal to the feeding direction).

In the configuration according to the first exemplary embodiment, the feeding cassette 20 is provided to be drawable in the direction orthogonal to the feeding direction. In contrast, the present invention may have a configuration in which the feeding cassette 20 can be drawn in the same direction as the feeding direction. Further, the present invention should not be limited to a configuration applicable to the feeding cassette 20.

A second exemplary embodiment of the present invention will be described below.

As for a configuration and an operation which are common to those in the first exemplary embodiment, redundant description thereof will be avoided in the second exemplary embodiment where appropriate.

According to the first exemplary embodiment, the size of sheets S can be determined when the sheets S are the A5 size (148 mm in width×210 mm in length) or larger as standard sizes. According to the second exemplary embodiment, the sizes of sheets S which are the A6 size (105 mm in width×148 mm in length) or larger size can be identified.

Figure 13:
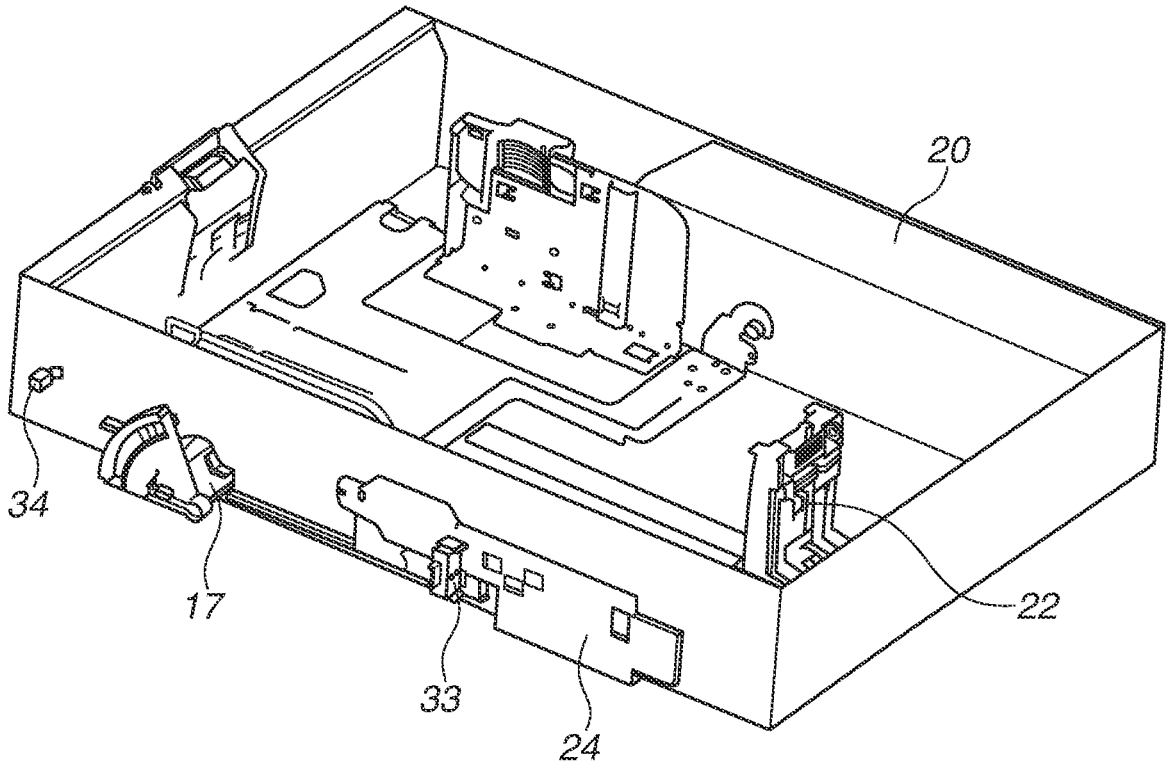
FIG. 13 is a perspective view of a feeding cassette according to a second exemplary embodiment.

FIG. 13 is a perspective view illustrating a feeding cassette 20 according to the second exemplary embodiment. According to the second exemplary embodiment, the feeding cassette 20 includes a micro switch 34, which is tuned on/off, in addition to a switch 33 having three pin switches. A determination unit D recognizes signals output from the switch 33 and the micro switch (second sensor) 34, as in the first exemplary embodiment. According to the second exemplary embodiment, the feeding cassette 20 includes three detection plates.

Figure 14:
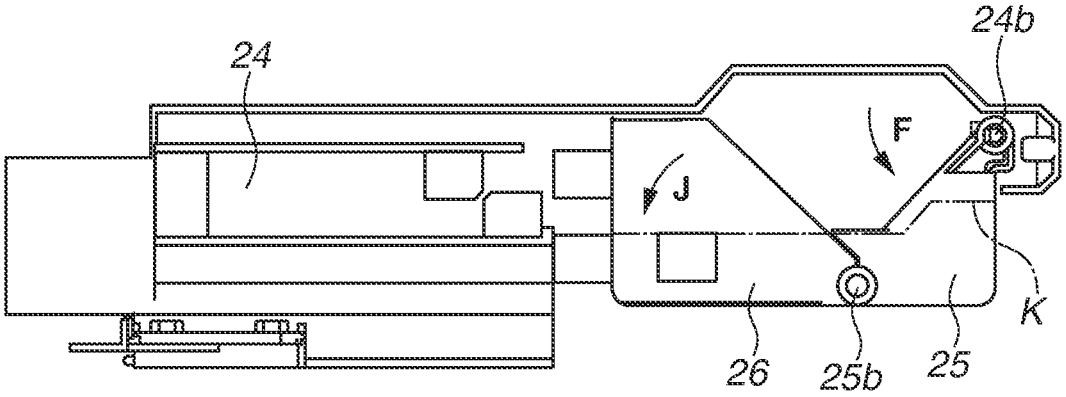
FIG. 14 is a side view of three detection plates according to the second exemplary embodiment.

FIG. 14 illustrates a first detection plate 24, a second detection plate 25, and a third detection plate (second pivoting member) 26 according to the second exemplary embodiment when viewed from the side in an enlarged scale. According to the second exemplary embodiment, the feeding cassette 20 includes the third detection plate 26 in addition to the first detection plate 24 and the second detection plate 25.

The first detection plate 24 has a plurality of openings provided according to a predetermined rule. The first detection plate 24 partly has a cutout portion (a lower part indicated by a two-dot and dash line K), and is configured such that a pivoting trajectory of a lift-up plate 17 and a sliding trajectory of the first detection plate 24, described above, do not interfere with each other, as in the first exemplary embodiment.

An engagement relationship between the three detection plates will be described below. As illustrated in FIG. 14, the second detection plate 25 is attached to the first detection plate 24. The second detection plate 205 is provided so as to smoothly pivot around a pivot point 24*b* of the first detection plate 24. The center of gravity and a pivot point 25*b* of the second detection plate 25 are set so that the second detection plate 25 pivots in a direction indicated by an arrow F around the pivot point 24*b* by its own weight. The second detection plate 25 is configured to stop pivoting by contacting a rib (not illustrated) of the feeding cassette 20.

The third detection plate 26 is attached to the second detection plate 25. The third detection plate 26 is provided so as to smoothly pivot around the pivot point 25*b* on the second detection plate 25. The center of gravity and a pivot point of the third detection plate 26 are set so that the third detection plate 26 also pivots in a direction indicated by an arrow J around the pivot point 25*b* by its own weight. The third detection plate 26 is configured to stop pivoting by contacting the rib (not illustrated) of the feeding cassette 20.

The second detection plate 25 and the third detection plate 26 are configured to cover the above-described cutout portion (the lower part indicated by the two-dot and dash line K) of the first detection plate 24.

According to the second exemplary embodiment, a length in a thickness direction of the first detection plate 24, the second detection plate 25 and the third detection plate 26 is set substantially the same as that in the first exemplary embodiment. More specifically, the first detection plate 24 is set partially thin (in a trajectory of the second detection plate 25 and the third detection plate 26) so that a gap between a detection surface of the first detection plate 24 and detection surfaces of the second detection plate 25 and the third detection plate 26 become as small as possible. According to the second exemplary embodiment, the gap is also 0.8 mm.

Figure 15:
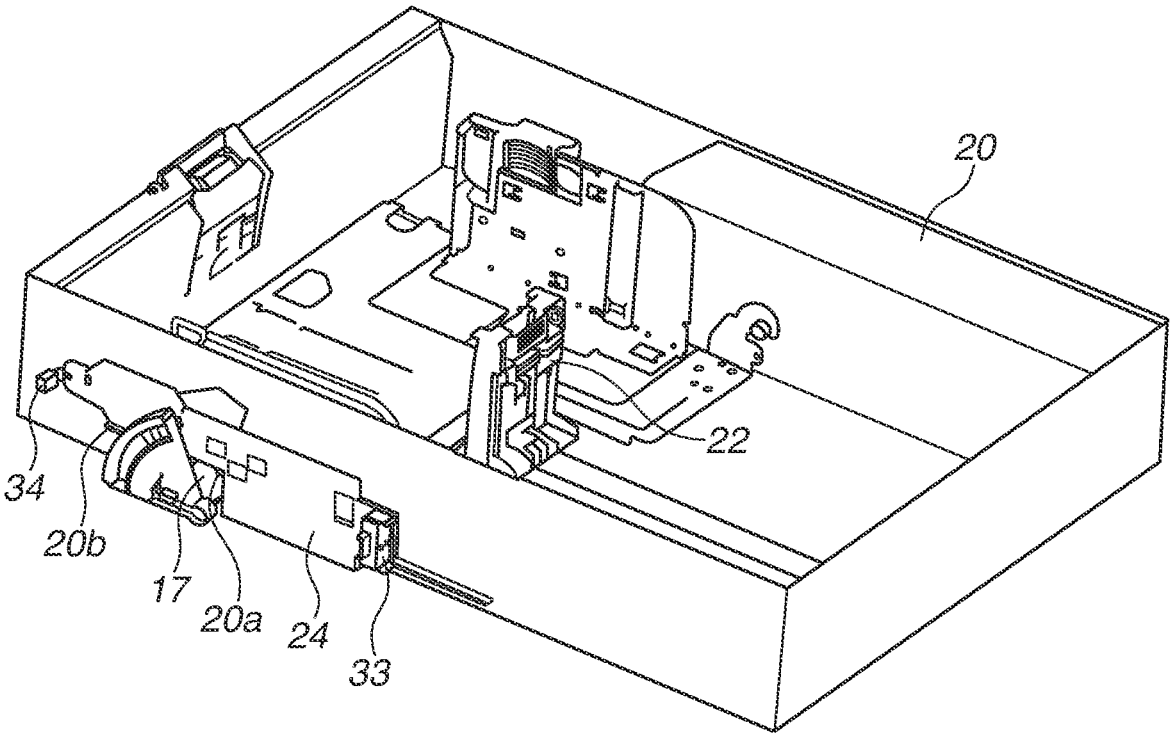
FIG. 15 is a perspective view of the feeding cassette when sheets of the A6 size are set therein according to the second exemplary embodiment.

FIG. 15 is a perspective view of the feeding cassette 20 when sheets S of the A6 size (105 mm in width×148 mm in length) are set. A relative positional relationship between the first detection plate 24, the second detection plate 25, the third detection plate 26, the switch 33, and the micro switch 34 is as illustrated in FIG. 15. In this case, the first detection plate 24 pushes in all the three pin switches of the switch 33. Therefore, three pin switches of the switch 33 are all in a turn-on state.

According to the first exemplary embodiment, it is determined that the sheets S of the non-standard size are set in the feeding cassette 20 when all the pin switches of the switch 33 are turned on. According to the second exemplary embodiment, when the first detection plate 24 turns on the micro switch 34, it can be recognized that the sheets S of the A6 size are set in the feeding cassette 20.

At this time, the second detection plate 25 and the third detection plate 26 retreat upward against their own weights by contacting (being pressed on) protrusions 20*a* and 20*b* provided in the feeding cassette 20. Therefore, according to the second exemplary embodiment, an operation of the lift-up plate 17 is not obstructed, similar to the first exemplary embodiment.

As described above, according to the second exemplary embodiment, the size of smaller sheets S can be determined in addition to having an effect of the first exemplary embodiment.

While an electrophotographic image forming process has been described as an example of an image forming unit that forms an image on sheets in the above-described first and second exemplary embodiments, the present invention is not limited to the image forming unit using the electrophotographic image forming process. For example, the image forming unit that forms an image on sheets includes the one using an inkjet image forming process for forming an image on sheets by discharging an ink liquid from a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a stacking plate on which a sheet is to be stacked;

a lift up device including a lifter gear and a lifter member, wherein the lifter member is configured to move with a rotation of the lifter gear and the lifter member is configured to raise and lower the stacking plate with the sheet;

a feeding member configured to feed the sheet stacked on the stacking plate;

an image forming unit configured to form an image on the sheet fed by the feeding member;

a regulation member configured to be movable in a first direction and a second direction opposite to the first direction and configured to regulate a position of the sheet by abutting on an edge of the sheet stacked on the stacking plate;

a first member configured to be detected and configured to move in a direction parallel to a moving direction of the regulation member in conjunction with the regulation member;

a second member, provided on the first member, and configured to be detected and configured to move with respect to the first member;

single sensor having an output configured to change based on a position of the first member and on a position of the second member;

a determination unit configured to determine a size of the sheet based on the output of the sensor; and a contacting portion configured to contact the second member, wherein the second member is configured to be in a first position facing the single sensor or a second position not facing the single sensor according to the movement of the regulation member, and wherein, when the second member is located at the second position, the second member moves to a retraction position retracting from the lifter member by contacting the contacting portion.

2. The image forming apparatus according to claim 1, wherein, when the second member is located at the retraction position, the second member is covered by the first member.

3. The image forming apparatus according to claim 1, wherein a cutout portion is formed in the first member.

4. The image forming apparatus according to claim 1, wherein the second member has a pivot axis, and the pivot axis is located over the stacking plate.

5. The image forming apparatus according to claim 1, wherein the first member has a thin portion, wherein a thickness of the thin portion in a direction orthogonal to the first direction is smaller than a thickness of a portion other than the thin portion, and wherein the second member is attached to the thin portion.

6. The image forming apparatus according to claim 1, wherein the second member has a weight and, by contacting the contacting portion, the second member is configured to pivot against the second member's own weight.

7. The image forming apparatus according to claim 1, wherein a pivoting range of the second member is set within a maximum external form of the first member.

8. The image forming apparatus according to claim 1, wherein the first member has a plurality of openings, and wherein the single sensor includes a plurality of switches to output, based on the plurality of openings, a signal indicating ON.

9. The image forming apparatus according to claim 1, wherein the stacking plate is disposed in a feeding cassette configured to be drawn from an apparatus body, wherein the single sensor and the determination unit are provided in the apparatus body, and wherein the feeding cassette includes the stacking plate and the lift up device.

10. The image forming apparatus according to claim 1, wherein the regulation member is a trailing edge regulation member configured to regulate a position of a trailing edge of the sheet in view of a feeding direction of the sheet.

* * * * *